US009016243B2

(12) United States Patent
Lankinen et al.

(10) Patent No.: US 9,016,243 B2
(45) Date of Patent: Apr. 28, 2015

(54) CIRCULATING FLUIDIZED BED BOILER

(75) Inventors: Pentti Lankinen, Varkaus (FI); Kari Kauppinen, Varkaus (FI); Pertti Kinnunen, Varkaus (FI)

(73) Assignee: Foster Wheeler Energia Oy, Espoo (FI)

( * ) Notice: Subject to any disclaimer, the term of this patent is extended or adjusted under 35 U.S.C. 154(b) by 537 days.

(21) Appl. No.: 13/262,928

(22) PCT Filed: Apr. 8, 2010

(86) PCT No.: PCT/FI2010/050281
§ 371 (c)(1),
(2), (4) Date: Nov. 22, 2011

(87) PCT Pub. No.: WO2010/116039
PCT Pub. Date: Oct. 14, 2010

(65) Prior Publication Data

US 2012/0067303 A1 Mar. 22, 2012

(30) Foreign Application Priority Data

Apr. 9, 2009 (FI) ..... 20095399

(51) Int. Cl.
*F23M 5/08* (2006.01)
*F23C 10/10* (2006.01)

(52) U.S. Cl.
CPC ..... *F23C 10/10* (2013.01)

(58) Field of Classification Search
CPC ..... F28G 7/00; F22B 31/0084
USPC ..... 122/379, 4 D; 432/15, 488, 489, 58; 165/104.16; 110/245, 216
See application file for complete search history.

(56) References Cited

U.S. PATENT DOCUMENTS 3,608,525 A * 9/1971 Sharan ..... 122/6 A
4,761,131 A * 8/1988 Abdulally ..... 431/7
5,094,191 A * 3/1992 Garkawe et al. ..... 122/4 D (Continued)

FOREIGN PATENT DOCUMENTS

EP 0 272 410 A2 10/1987
RU 2 104 442 C1 2/1998

OTHER PUBLICATIONS

Finnish Office Action dated Dec. 7, 2009, issued in counterpart Finnish application No. 20095399.
Morin, Jean-Xavier. "Recent Alstom Power Large CFB and Scale up aspects including steps to Supercritical," 47th International Energy Agency Workshops on Large Scale CFB, Zlotnicki, Poland, Oct. 13, 2003, pp. 1-15.

(Continued)

*Primary Examiner* — Steven B McAllister
*Assistant Examiner* — Rabeeul Zuberi
(74) *Attorney, Agent, or Firm* — Fitzpatrick, Cella, Harper & Scinto

(57) ABSTRACT

A circulating fluidized bed boiler includes a rectangular furnace having multiple particle separators connected to an upper portion of each of a front wall and a back wall of the furnace. Each particle separator includes a gas outlet, and a flue gas duct system connected to the gas outlets for conducting cleaned flue gas to a back pass. The particle separators are arranged in pairs. Each pair includes a front separator arranged adjacent to the front wall and a back separator arranged adjacent to the back wall. The flue gas duct system includes cross over ducts, each duct connecting the gas outlet of a front separator of a pair of particle separators, across and over the furnace, to the gas outlet of the back separator of the same pair of particle separators, and to the back pass, which back pass is arranged on the back wall side of the furnace.

11 Claims, 2 Drawing Sheets

(56) References Cited

U.S. PATENT DOCUMENTS

| | | | | |
|---|---|---|---|---|
| 5,215,042 | A | 6/1993 | Beisswenger et al. | |
| 5,490,469 | A * | 2/1996 | Brannstrom et al. | 110/245 |
| 5,508,007 | A | 4/1996 | Vidal et al. | |
| 5,658,359 | A * | 8/1997 | Berg et al. | 48/197 R |
| 6,039,008 | A * | 3/2000 | Anderson et al. | 122/510 |
| 6,470,833 | B1 * | 10/2002 | Hyppanen | 122/4 D |
| 6,481,385 | B1 * | 11/2002 | Gummel et al. | 122/4 D |
| 6,779,492 | B2 | 8/2004 | Baglione et al. | |
| 6,938,780 | B2 * | 9/2005 | Baglione et al. | 209/717 |
| 7,244,400 | B2 * | 7/2007 | Darling | 422/147 |
| 7,287,477 | B2 * | 10/2007 | Gounder | 110/345 |
| 7,427,384 | B2 * | 9/2008 | Kinnunen | 423/243.08 |
| 2007/0078773 | A1 | 4/2007 | Czerniak | |
| 2007/0079773 | A1 * | 4/2007 | Morin et al. | 122/459 |

OTHER PUBLICATIONS

Hotta, Arto, et al. "Milestones for CFB and OTU Technology: The 460 MWe Lagisza Supercritical Boiler Project Update," presented at CoalGen, Milwaukee, WI, Aug. 1, 2007, pp. 1-8.

Notification of and International Search Report mailed Jun. 23, 2010, in counterpart International application No. PCT/FI2010/050281.

Written Opinion mailed Jun. 23, 2010, in counterpart International application No. PCT/FI2010/050281.

Russian Decision on Grant issued on Apr. 8, 2013, in counterpart Russian Patent Application No. 20011145315/06 (067865), with an English translation.

* cited by examiner

CIRCULATING FLUIDIZED BED BOILER

This application is a U.S. national stage application of PCT International Application No. PCT/FI2010/050281, filed Apr. 8, 2010, published as PCT Publication No. WO 2010/116039 A1, and which claims priority from Finnish patent application number 20095399, filed Apr. 9, 2009.

FIELD OF THE INVENTION

The present invention relates to a circulating fluidized bed (CFB) boiler, and more particularly, the present invention relates to a large CFB boiler typically having a capacity of more than about 300 MWe, and comprising multiple particle separators connected in parallel to each of the two long sidewalls of the furnace. The invention is particularly directed to the arrangement of a flue gas duct system, which is used for conducting cleaned flue gas from the particle separators to a back pass.

Streams of flue gas and solid particles entrained therewith are generally discharged from the furnace of a large CFB boiler through flue gas discharge channels to multiple particle separators, usually, cyclone separators, arranged in parallel. Particles separated from the flue gas in the particle separators are returned back to the furnace, while cleaned flue gas is conducted via the flue gas in the back pass, and cooled flue gas is led from the back pass further to different gas cleaning steps and, finally, to a stack, or, in oxyfuel combustion, to carbon dioxide sequestration.

BACKGROUND OF THE INVENTION

In small and medium size CFB boilers, typically having a capacity of about 300 MWe or less, there are usually from one to four particle separators, which are all arranged on one sidewall of the boiler. In large size CFB boilers, having a capacity of more than about 300 MWe, there are typically multiple particle separators arranged on each of the two opposite long sidewalls of the boiler. When all the particle separators are connected on the same sidewall of the furnace, or there is only one particle separator, it is known to arrange the back pass on the same side of the furnace as the separators, whereby the arrangement is known as an in-line construction. Alternatively, the back pass and the one or more particle separators arranged on one side of the furnace can be positioned on opposite sides of the furnace, whereby the construction is known as an over-the-top-construction, because the flue gas ducts, connecting the gas outlets of the particle separators to the back pass, conduct cleaned flue gas over the top of the furnace.

Large size CFB boilers, having multiple particle separators on each of the two opposite long sidewalls of the boiler, usually have a furnace with a rectangular cross section, in which the width of the long sidewalls is clearly larger than the width of the short sidewalls. Such large CFB boilers have, according to the prior art, a back pass arranged adjacent to a short sidewall of the furnace. The gas outlet tubes of the particle separators arranged on the same sidewall, the number of which being typically at least three, are connected to a common flue gas duct, which conducts the clean flue gases to the back pass. Because there are particle separators on both long sidewalls of the furnace, the flue gas duct system naturally comprises two flue gas ducts. Such flue gas ducts are then arranged parallel to the long dimension of the horizontal cross section of the furnace, either above the separators, or on top of the furnace. An example of a CFB boiler with flue gas ducts above the separators is described in the article "Milestones for CFB and OTU Technology—The 46 MWe Lagisza Design Supercritical Boiler Project Update", presented at a CoalGen Conference in Milwaukee, Wis., in August, 2007.

The flue gas ducts of large CFB boilers of the type described above are fairly long, for example, more than thirty meters in the largest CFB boilers of today. Therefore, the flue gas ducts have to be well supported, in order to obtain sufficient stability and durability of the construction. According to an advantageous arrangement, disclosed in U.S. Pat. No. 7,244,400, the flue gas ducts are formed above the furnace, as extensions of the furnace walls. This arrangement provides a rigid and durable construction, which, to some extent, minimizes the problems related to the conventional construction of long flue gas ducts.

Each of the two flue gas ducts of a conventional large circulating fluidized bed boiler collects flue gas from, for example, three or four separators. Thus, the gas flow becomes, especially at the final sections of a flue gas duct, very high, and potentially eroding, unless the cross section of the flue gas duct increases towards the end. Such gradually widening flue gas ducts are, however, complicated constructions. Another possibility is that the long flue gas ducts have a constant cross-sectional area that is wide enough to maintain a sufficiently low flow velocity even at the end. Such construction increases the weight of the flue gas ducts and may cause problems due to the non-constant velocity of the flue gas flow.

The article "Recent Alstom Power Large CFB and Scale up aspects including steps to Supercritical," presented at the $47^{th}$ International Energy Agency Workshop on Large Scale CFB, Zlotnicki, Poland, on Oct. 13, 2003, shows a large CFB boiler having three particle separators on each of the long sidewalls, in which the outlet ducts of the particle separators on each side are connected together by a collecting channel and further to the back pass by a common flue gas duct, which flue gas ducts are connected to the centers of the collecting channels. This arrangement provides a complicated construction, which is, for example, difficult to support.

SUMMARY OF THE INVENTION

In order to minimize the problems described above, the present invention provides a circulating fluidized bed boiler according to the claims. Thus, the present invention provides a circulating fluidized bed boiler comprising a rectangular furnace that is horizontally enclosed by a front wall, a back wall and two sidewalls, wherein the common width of the front wall and the back wall is larger than the common width of the sidewalls, and multiple particle separators are connected to the upper portion of each of the front wall and the back wall for separating particles from a stream of flue gas and particles discharged from the furnace, wherein each particle separator comprises a gas outlet for discharging cleaned flue gas from the particle separator, and a flue gas duct system connected to the gas outlets of the particle separators for conducting cleaned flue gas to a back pass, wherein the multiple particle separators are arranged in multiple pairs of particle separators, wherein each pair of particle separators includes a front separator arranged adjacent to the front wall and a back separator arranged adjacent to the back wall, and the flue gas duct system comprises multiple cross over ducts, each cross over duct connecting the gas outlet of a front separator of a pair of particle separators, across and over the furnace, to the gas outlet of the back separator of the same pair of particle separators, and to the back pass, which back pass is arranged on the back wall side of the furnace, outside of the back separators.

As described above, in large circulating fluidized bed boilers having particle separators arranged on both long sidewalls of the furnace, the back pass is conventionally arranged adjacent to a short sidewall of the furnace. Thus, the cleaned flue gases are conventionally conducted to the back pass along two flue gas ducts arranged along the two long sidewalls. The present inventors have surprisingly noticed that a more advantageous layout of the boiler plant can be obtained by not arranging the back pass near to one of the short sidewalls of the furnace, but on one of the long sidewalls, and conducting the flue gas discharged from each pair of particle separators to the back pass along a cross over duct that extends across and over the furnace to the back pass.

The cross over ducts according to the present invention appear to provide a non-advantageous construction because they break the longitudinal symmetry of a boiler having particle separators on both long sidewalls. However, various considerations, which will be described below, show that this construction leads, after all, to a very advantageous construction of the flue gas duct system and to a compact overall layout of the power plant.

A main reason for the advantageousness of the present invention is, as the present inventors have observed, that it is easier to arrange many relatively short flue gas ducts, which each connect two particle separators to the back pass, than to have two long flue gas ducts, which each connect many particle separators to the back pass. Such relatively short flue gas ducts, i.e., cross over ducts, are easier to support than are longer flue gas ducts extending along the long sidewalls of the furnace. The present invention is especially advantageous in large circulating boilers where the horizontal cross section of the furnace is elongated in such a way that the width of the front wall and the back wall is clearly larger than the width of the short sidewalls. Thus, the present invention is especially advantageous when the width of the front wall and the back wall is at least about three times the width of the short sidewalls.

Main support beams of a rectangular furnace are advantageously arranged perpendicular to the long dimension of the horizontal cross section of the furnace. Thus, the cross over ducts according to the present invention are aligned with the main support beams, which brings about a possibility to form a compact general layout, where the cross over ducts may even be arranged at least partially between the main support beams. Therefore, in a large circulating fluidized bed boiler, having preferably at least three, even more preferably at least four, particle separators on each of the long sidewalls of the furnace, it is advantageous to connect each pair of particle separators, consisting of a particle separator on the front wall and a corresponding particle separator on the back wall, by a common cross over duct to the pack pass.

A flue gas duct system according to the present invention preferably comprises at least three, even more preferably at least four, parallel cross over ducts. Each of the cross over ducts has advantageously the same dimensions, i.e., the same length and the same cross section, up to the level of the back wall of the back pass. Thus, the cross over ducts can be manufactured economically as a series work. The supporting of the cross over ducts can then also be made in a straightforward and advantageous manner.

Due to their similar dimensions, each of the cross over ducts provides nearly the same pressure drop for the flue gas. Thus, the combustion conditions can easily be made similar at the center of the furnace as close to each of the short sidewalls, and it is possible to obtain an optimal and environmentally advantageous combustion process throughout the furnace.

According to an advantageous embodiment of the present invention, the cross-sectional area of the portion of each cross over duct, which is located between a back separator and the back pass, is about twice as large as the cross-sectional area of the portion between a front separator and the back separator. Due to the increasing cross-sectional area, the velocity of the flue gas remains approximately constant throughout the cross over ducts. Such a constant velocity renders it possible to have low turbulence in the flue gas flow and minimized erosion caused by particles entrained with the flow.

The flue gas duct system advantageously comprises water or steam tubes for transferring heat from the flue gas to water or steam. According to an advantageous embodiment of the present invention, each cross over duct has a rectangular cross section with a constant width and a height that is between the back separator and the back pass approximately twice the height between the front separator and the back separator. The constant width is advantageous for arranging support beams of the furnace between cross over ducts.

The increase of the cross section is advantageously made by keeping the top surface of the duct at a constant level, and increasing the height of the duct downwards at the point where the gas flow from the back separator merges with that from the front separator. Thus, between the front separator and the back separator, i.e., above the furnace, there is a free space, which can be advantageously used, for example, for arranging suspension means for heat exchangers within the furnace.

The flue gas ducts are advantageously made of straight water tube panels, which are bent in a suitable manner to obtain the required shape, especially, at the point where the gas flow from the back separator merges with that from the front separator. A cooled flue gas duct system is advantageous as a durable and light weight construction. The making of simple-shaped cross over ducts, according to the present invention, thus renders it possible to manufacture a cooled flue gas system economically, by using straight water tube panels.

Due to the use of only one increasing section, instead of, for example, two or three increasing sections required in a corresponding flue gas duct connecting three or four particle separators on a long sidewall, a relatively smooth flow of the flue gas can be obtained in the cross over ducts according to the present invention. The junction of the flue gas flows form a back separator and from the corresponding front separator is directed at the junction to be aligned with the flow from the front separator. By this arrangement, the flue gases flow smoothly through the flue gas duct system without a high pressure drop or heavy turbulence, which might cause high erosion at the internal surfaces of the systems due to remaining fly ash entrained with the flue gas.

Cooled flue gas duct systems are conventionally internally protected, in order to avoid erosion, by a refractory layer. However, due to the simple and optimized shape of the cross over ducts according to the present invention, at least a portion of the duct system is advantageously not protected by a refractory layer, but the flue gas is allowed to contact the metal surface of the water or steam tube panels of the cross over ducts. Thereby, the manufacturing costs of the cross over ducts are decreased and the heat transfer rate at the surfaces is improved.

The back pass has advantageously a rectangular cross section with a first long sidewall facing the back wall and two short sidewalls being parallel to the short sidewalls of the furnace. Thereby, all cross over ducts may be connected to the upper portion of the first long sidewall of the back pass. However, according to a preferred embodiment of the present invention, which is especially useful when there are at least four cross over ducts, the two centermost cross over ducts are connected to the first long sidewall, but the two outermost cross over ducts are connected by a bending channel to the upper portion of the short sidewalls of the back pass. This construction renders it possible to arrange an identical pillars system for supporting all the main support beams. By this construction, it is also possible to obtain an even flow of flue gas to the back pass, which improves the heat transfer efficiency in the heat exchange surfaces in the back pass.

The above brief description, as well as further objects, features, and advantages of the present invention will be more fully appreciated by reference to the following detailed description of the currently preferred, but nonetheless, illustrative, embodiments of the present invention, taken in conjunction with the accompanying drawings.

DETAILED DESCRIPTION OF THE PREFERRED EMBODIMENTS

Figure 1:
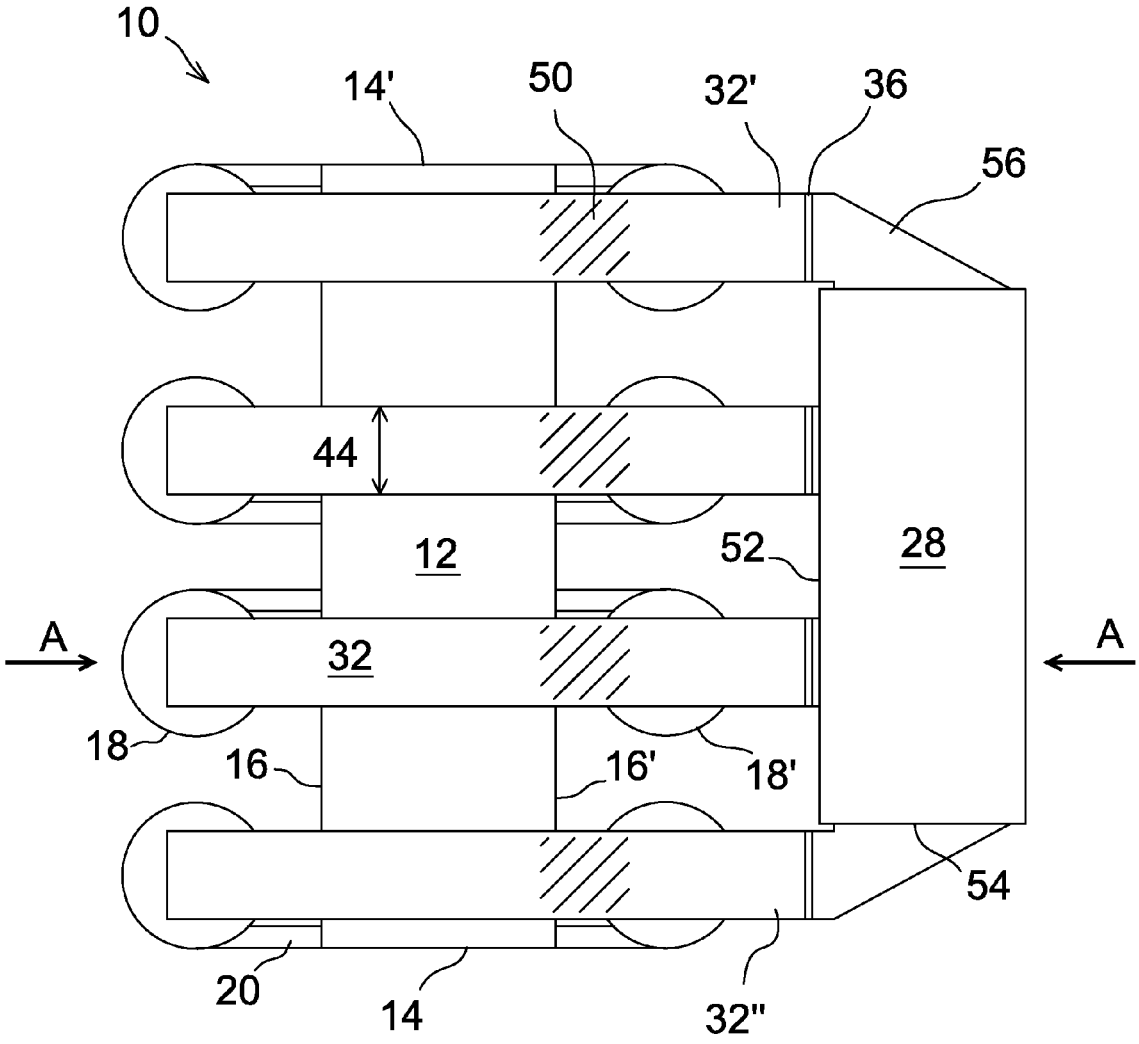
FIG. 1 is a schematic top view of the circulating fluidized bed boiler in accordance with a preferred embodiment of the present invention.
Figure 2:
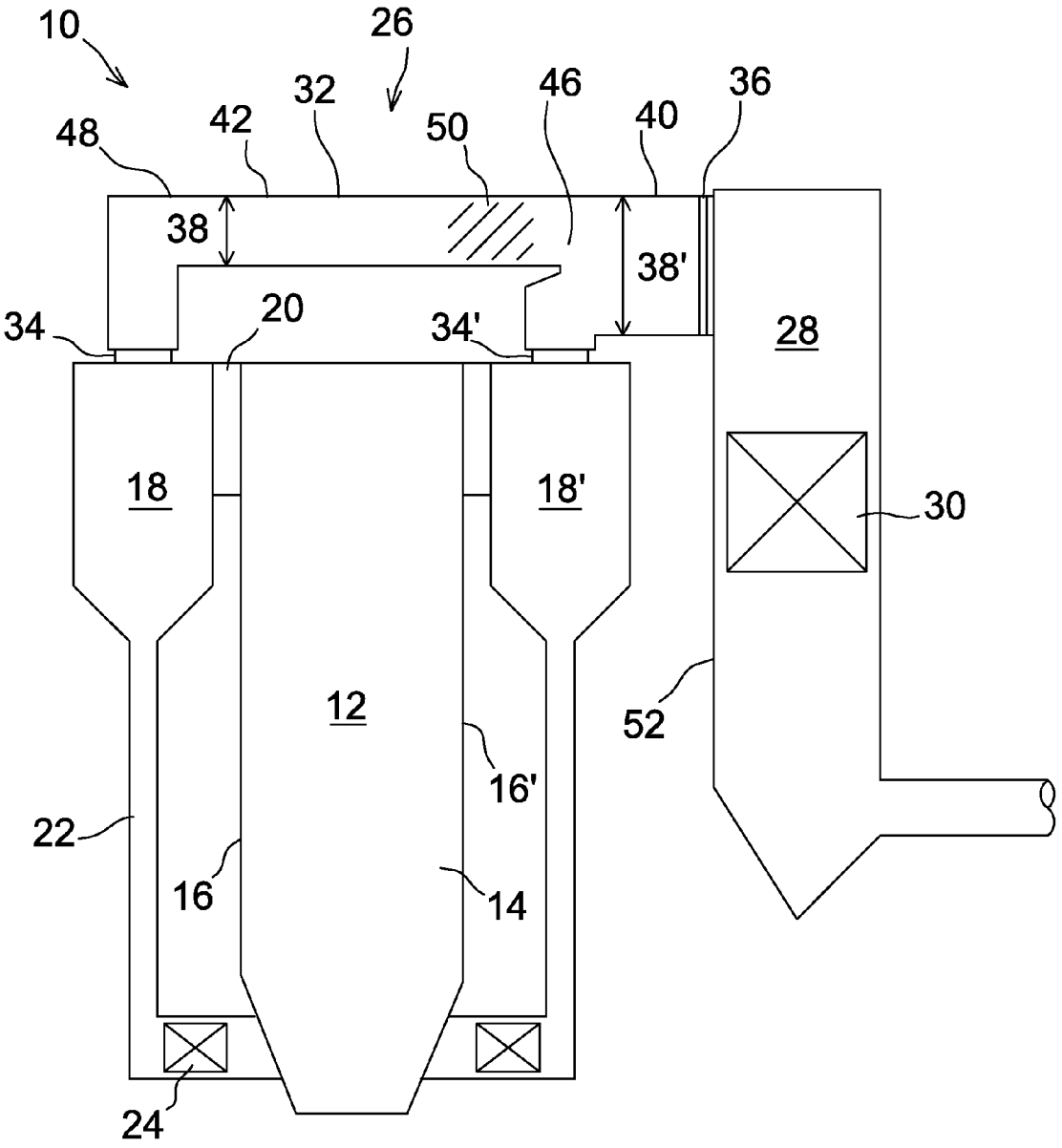
FIG. 2 is a schematic vertical cross section of the circulating fluidized bed boiler shown in FIG. 1.

FIG. 1 shows a schematic top view of a circulating fluidized bed (CFB) boiler 10 in accordance with the present invention, and FIG. 2 shows a schematic vertical cross-sectional view of the CFB boiler, taken along line A-A of FIG. 1. The furnace 12 of the CFB boiler has a rectangular cross section, having two short sidewalls 14, 14' and two long sidewalls, the front wall 16 and the back wall 16'. Multiple particle separators 18, 18' are connected by flue gas discharge channels 20 to each of the long sidewall. The number of particle separators on each long sidewall is here four, but it could also be, for example, three, or even more than four.

When fuel is combusted in the furnace 12, hot flue gas and particles entrained therewith are discharged through the flue gas discharge channels 20 to the particle separators 18, 18'. Particles separated from the flue gas in the particle separator 18, 18' are returned back to the lower portion of the furnace 12 via return ducts 22. The return ducts may advantageously comprise heat exchange surfaces 24 to recover heat from the recycled hot particles.

Streams of cleaned flue gas are conducted through a flue gas duct system 26 to a back pass 28. The back pass usually comprises heat exchange surfaces 30 for transferring heat from the flue gas to a heat transfer medium. In FIG. 1, there is symbolically shown only one heat exchange surface 30, but, in practice, there are usually several heat exchange surfaces, such as superheaters, reheaters, economizers and air heaters. Cooled flue gas is conducted from the back pass further to gas cleaning stages, such as a dust collector and a sulfur dioxide scrubber, not shown in FIG. 1. The cleaned flue gas is finally released to the environment through a stack, or it is, in oxyfuel combustion, conducted further to carbon dioxide sequestration.

Usually, in large CFB boilers, having multiple particle separators on both long sidewalls of the furnace, the back pass is arranged adjacent to one of the short sidewalls of the furnace. The present CFB boiler 10 is, however, based on a different layout, where the back pass 28 is arranged on a side of the back wall 16' of the furnace, outside of the particle separators 18'. As can be best seen in FIG. 1, this arrangement provides a compact layout, which is advantageous, for example, in enabling to support the system, i.e., the furnace 12, particle separators 18, 18', back pass 28 and flue gas duct system 26 on a compact steel construction (not shown in the Figures). By this arrangement, the maximum dimensions of the boiler building, not shown in the Figures, is decreased, and the overall length of different channels and pipes, for transporting, for example, air, fuel, flue gas, water and steam, is minimized.

According to the present invention, each particle separator 18 on the front wall 16, a so-called front separator, and the particle separator 18' on the corresponding location on back wall 16', and a so-called back separator, form a pair of particle separators, which is connected together by a common cross over duct 32. Thus, the flue gas duct system 26 consists mainly of multiple cross over ducts 32, 32', 32", which each connect the gas outlet 34 of a front separator 18 of a pair of particle separators, across and over the furnace 12, to the gas outlet 34' of the back separator 18' of the same pair of particle separators, and, further, to the back pass 28.

As can be seen in FIG. 1, each cross over duct 32, 32', 32" is shorter than a conventional flue gas duct, connecting all the particle separators on a long sidewall to a back pass arranged adjacent to a short sidewall, would be. Because the problems related to the rigidity and stability of a structure increase rapidly with an increasing length of the structure, the present construction provides, especially for very large CFB boilers, having preferably a capacity of more than 300 MWe, even more preferably of more than 500 MWe, an improvement to the conventional construction.

A flue gas duct system 26, according to the present invention, comprises preferably at least three, even more preferably at least four, cross over ducts 32, 32', and 32". The cross over ducts 32, 32', 32" are preferably identical with each other, i.e., they have identical cross sections and the same length, up to a bellows 36. Thus, they each provide a nearly identical pressure drop for the flue gas, which helps to obtain a uniform and optimized combustion process in the furnace 12. The identical cross over ducts 32, 32', 32" are preferably constructed of straight water tube panels, which can be manufactured economically as a series work.

As can be seen in FIG. 2, the height 38' of the final portion 40 of the cross over ducts 32, 32', 32", i.e., between the back separator 18' and the back pass 28, is advantageously about twice the height 38 of the first portion 42 of the cross over ducts 32, 32', 32", i.e., between the front separator 18 and the back separator 18'. On the other hand, as can be seen in FIG. 1, the width 44 of the cross over ducts 32, 32', 32" is advantageously constant through the ducts. Thus, the cross-sectional area of cross over ducts 32, 32', 32" changes at the junction 46, i.e., at the point at which the gas flow from the back separator 18' merges with that from the front separator 18, to be about twice as large as it is in the first portion 42. While the final portion 40 collects flue gases from two separators, the flue gas flow velocity is approximately constant through the cross over ducts 32, 32', 32". Thus, the velocity of the flue gas in the cross over ducts can easily be optimized, so that the eroding effect of fly ash particles entrained with the flue gas is at a tolerable level.

As is seen in FIG. 1, the increase of the cross-sectional area of the cross over ducts 32, 32', 32" at the junction 46 is advantageously made by keeping their top wall 48 at a constant level while increasing the height of the ducts downwards. This construction can advantageously be made mainly be bending straight water or steam tube panels to the required shape. The simple-shaped cross over ducts, according to the present invention, thus render it possible to efficiently cool the flue gases in a cost-effective flue gas duct system.

The flue gas flow from the front separator 18 is conducted through the first portion 42 of the cross over duct 32 and across the top of the furnace 12 before the flue gas from the back separator 18' is merged with it. Therefore, the flue gas flow has, upstream of the junction 46, a well defined direction in the cross over duct. This well-developed directionality of the flue gas flow from the front separator, a so-called initial flow, renders it possible to merge the flue gas flow from the back separator 18' with it in such a manner that the flue gas from the back separator does not essentially disturb the initial flow. The merging of the flue gas flows is advantageously made by directing the flue gas flow from the back separator 18' to be aligned with the initial flow at the junction 46. This arrangement lowers the turbulence and pressure drop in the cross over ducts 32, 32', 32" and minimizes erosion of the internal surfaces of the cross over ducts.

It is generally known to protect flue gas ducts internally by a refractory layer. Due to the simple and optimized shape of the cross over ducts 32, 32', 32", at least a portion 50 of the duct system is, according to a preferred embodiment of the present invention, not protected by a refractory layer, but the flue gas is allowed to contact the metal surface of the water or steam tube panels of the cross over ducts. Such an unprotected region 50 is advantageously provided close to the downstream end of the first section 42 of the cross over ducts 32, 32', 32". The use of an unprotected portion 50 lowers the weight and the manufacturing costs of the cross over ducts, and improves the heat transfer rate at the surfaces of the cross over ducts 32, 32', 32".

The back pass 28 has advantageously a rectangular cross section with a first long sidewall 52 facing the back wall 16' and two short sidewalls 54 parallel to the short sidewalls 14, 14' of the furnace. The cross over ducts 32, 32', 32" may be connected to the upper portion of the first long sidewall 52 of the back pass 28. However, according to a preferred embodiment of the present invention, which is shown in FIG. 1, and which is especially useful when there are at least four cross over ducts 32, 32', 32", the two outermost cross over ducts 32', 32" are connected by a bending section 56 to the upper portion of the short sidewalls 54 of the back pass 28 and only the remaining, centermost cross over ducts 32 are connected to the first long sidewall 52. This arrangement renders it possible to obtain a relatively even flow of the flue gas also in the back pass 28, which improves the heat transfer efficiency in the heat exchange surfaces 30 in the back pass. By using an identical shape of the cross over ducts 32, 32', 32", up to the bellows 36, it is possible to arrange a regular array of supporting pillars, not shown in FIG. 1, of the boiler 10 between the cross over ducts.

While the present invention has been described herein by way of an example in connection with what is, at present, considered to be the most preferred embodiment, it is to be understood that the invention is not limited to the disclosed embodiment, but is intended to cover various combinations or modifications of its features and several other applications included within the scope of the invention as defined in the appended claims.

The invention claimed is:

1. A circulating fluidized bed boiler comprising:

a rectangular furnace, which is horizontally enclosed by a front wall, a back wall, and two sidewalls, for combusting fuel and combustion gas therein and generating a stream of flue gas particles, wherein a common width of each of the front wall and the back wall is greater than a common width of the sidewalls;

multiple particle separators, inlets of which are connected to an upper portion of each of the front wall and the back wall, for separating particles from the stream of flue gas and particles discharged from the furnace, the multiple particle separators being arranged in multiple pairs of particle separators, each pair of particle separators including a front separator arranged adjacent to the front wall of the furnace and a back separator arranged adjacent to the back wall of the furnace, wherein each particle separator comprises a gas outlet for discharging cleaned flue gas from the particle separator; and a flue gas duct system connected to the gas outlets of the particle separators for conducting cleaned flue gas to a back pass, the flue gas duct system comprising at least three cross over ducts, each cross over duct connecting the gas outlet of a front separator of a pair of particle separators, across and over the furnace, to the gas outlet of the back separator of the same pair of particle separators, and to the back pass, which back pass is arranged on the back wall side of the furnace, outside of the back separators, wherein (i) the width of each of the front wall and the back wall is at least three times the width of the sidewalls, (ii) the multiple pairs of particle separators comprise at least three pairs of particle separators, (iii) the back pass has a rectangular cross section with a first long sidewall facing the back wall and two short sidewalls being parallel to the short sidewalls of the furnace, (iv) the two outermost cross over ducts of the at least three cross over ducts, which are located nearest to the short sidewalls of the furnace, comprise bending sections; the bending sections being directly connected to the short sidewalls of the back pass, and (v) the other cross over ducts of the at least three cross over ducts are connected directly to the first long sidewall of the back pass.

2. A circulating fluidized bed boiler according to claim 1, wherein the multiple pairs of particle separators comprise at least four pairs of particle separators.

3. A circulating fluidized bed boiler according to claim 1, wherein each of the multiple cross over ducts has mainly the same dimensions.

4. A circulating fluidized bed boiler according to claim 1, wherein the flue gas duct system comprises water or steam tubes for transferring heat from the flue gas to water or steam.

5. A circulating fluidized bed boiler according to claim 4, wherein the cross over ducts are made of straight water tube panels.

6. A circulating fluidized bed boiler according to claim 1, wherein the cross over ducts have a constant width and the height of each cross over duct between a back separator and the back pass is approximately twice the height of the cross over duct between the back separator and a front separator.

7. A circulating fluidized bed boiler according to claim 6, wherein the cross over ducts have a top wall at a constant level.

8. A circulating fluidized bed boiler according to claim 1, wherein at least a portion of the flue gas duct system is internally protected by a refractory layer.

9. A circulating fluidized bed boiler according to claim 8, wherein a portion of the flue gas duct system is not protected by a refractory layer.

10. A circulating fluidized bed boiler according to claim 1, wherein each of the cross over ducts comprises a junction for merging flue gases discharged from a front separator with flue gases discharged from a back separator, which junction is formed so as to direct the flue gases discharged from the back separator to be aligned with the flue gases discharged from the front separator.

11. A circulating fluidized bed boiler according to claim 1, wherein the inlets of the multiple pairs of particle separators are respectively connected to the upper portions of the front wall and the back wall.

* * * * *